United States Patent [19]

Hawkins

[11] Patent Number: 4,796,825

[45] **Date of Patent: * Jan. 10, 1989**

[54] ELECTRONIC PAPER TOWEL DISPENSER

[76] Inventor: Junior F. Hawkins, 3120 W. 16th, Wichita, Kans. 67203

[ * ] Notice: The portion of the term of this patent subsequent to Jan. 26, 2005 has been disclaimed.

[21] Appl. No.: 100,904

[22] Filed: Sep. 25, 1987

Related U.S. Application Data

[63] Continuation-in-part of Ser. No. 877,159, Jun. 23, 1986, abandoned, and Ser. No. 872,041, Jun. 9, 1986, Pat. No. 4,721,265.

[51] Int. Cl.[4] ..... B65H 16/00; G01V 9/04

[52] U.S. Cl. ..... 242/55.53; 242/55.2; 250/221

[58] Field of Search ..... 242/55.53, 55.2; 250/221, 548

[56] References Cited

U.S. PATENT DOCUMENTS

| | | | |
|---|---|---|---|
| 2,565,994 | 8/1951 | Sevenich | 242/55.53 |
| 3,384,280 | 5/1968 | Summersby | 242/55,53 X |
| 3,450,363 | 6/1969 | Williams | 242/55.53 |
| 3,667,825 | 6/1972 | Pagel | 242/55.53 X |
| 3,951,485 | 4/1976 | Schnyder et al. | 242/55.53 X |
| 4,071,200 | 1/1978 | Stone | 242/55.2 |
| 4,192,442 | 3/1980 | Bastian et al. | 242/55.53 X |
| 4,270,818 | 6/1981 | McCabe | 242/55.53 X |
| 4,329,581 | 5/1982 | Helfrich et al. | 250/221 |

*Primary Examiner*—John Petrakes
*Assistant Examiner*—Joseph J. Hail, III
*Attorney, Agent, or Firm*—John Wade Carpenter

[57] ABSTRACT

The electronic paper towel dispenser permits paper towels to be dispensed from a supply roll by placing your hand or other object in front of a sensor located on or near the front of the supply cabinet. Dispensing of the paper towels is stopped when your hand or other object is removed from in front of the sensor or whenever normal room lighting is not present.

6 Claims, 1 Drawing Sheet

ELECTRONIC PAPER TOWEL DISPENSER

This is a continuation-in-part application of my copending application having Ser. No. 877,159, filed June 23, 1986 now abandoned, and of my copending application Ser. No. 872,041, filed June 9, 1986 now U.S. Pat. No. 4,721,265. Benefit of the earlier filing dates for both copending patent applications is claimed with respect to the common subject matter known.

BACKGROUND OF THE INVENTION

1. Field of the Invention

This invention relates to an electronic means of dispensing paper towels.

2. Description of the Prior Art

Prior to my invention there was no improved means available for dispensing paper towels without pulling on the towel itself or operating a mechanical device to dispense said towel.

SUMMARY OF THE INVENTION

The electronic paper towel dispenser permits paper towels to be dispensed in the length desired by placing your hand or other object in front of a sensor. The dispensing of towels is stopped when your hand or other object is removed from in front of said sensor or whenever normal room lighting is not present.

Dispensing paper towels without having to touch anything permits those individuals with arthritis or other afflictions to easily dispense paper towels who otherwise might have difficulty seeing, grasping, finding or pulling on the towel or other device to dispense said towels. This invention also permits those individuals with paint, grease or other bulky or sticky substance on their hands to easily dispense towels who would otherwise either have difficulty grasping the end of the towel or would get the said substance on any mechanical operating device which would then have to be cleaned.

In addition, in restrooms, kitchens and similar places this device permits paper towels to be dispensed as may be needed without touching a mechanical surface which may have been contaminated by people who previously used the mechanical towel dispensing device without washing their hands or without having washed their hands well.

The present invention broadly accomplishes its desired objects by broadly providing a paper towel dispenser comprising a cabinet means including a back panel; a top pivotally secured to said back panel, a first side panel secured to the back panel, a second side panel having a side opening and secured to the back panel, a front panel secured to the first and second side panels, and a bottom panel having a bottom opening and secured to the first and second side panels and to the front and back panels. A motor means is secured to the back panel for producing rotational energy; and a control circuit means is mounted in the cabinet means and comprises a touchless switch means for energizing and de-energizing the motor means and dispensing paper towels in a sanitary manner. A cone-shaped bearing means is coupled to the motor means and frictionally, rotationally engages one side of paper towels for dispensing same when the motor means is energized; and a stop member is mounted to the back panel. A second bearing means releasably engages another side of the paper towel and supports the same while being rotationally dispensed when the cone-shaped bearing means is rotated by the motor means. A bracket assembly is integrally bound to the second bearing means and is superimposed over the stop member and slidably mounted along the back panel in proximity to the side opening; and a means is secured to the stop member and to the bracket assembly for biasing the bracket assembly away from the stop member and for biasing the second bearing means towards the paper towels.

The control circuit means of this invention comprises a first conductor means in communication with a power source at one end and grounded at the other end; and a day sensor means and a first variable resistor and a first resistor, all connected in series in the first conductor means. A second conductor means is connected to the first conductor means between the first variable resistor and the first resistor and is further connected to a logic circuit operation 4081 AND means. A third conductor means is provided having one end in communication with the power source and another end grounded; and a night sensor means and a second variable resistor and a second resistor are all connected in series in the third conductor means. A fourth conductor means is attached to the logic circuit operation 4081 AND means and to the third conductor means between the second variable resitor and the second resistor. A fifth conductor means is attached to the logic circuit operation 4081 AND means and is in communication with the power source, and a third resistor and a first transistor and the motor means are all connected in series in the fifth conductor means. The first transistor has a first base, a first emitter and a first collector. A second transistor is provided having a second base, a second emitter and a second collector. The first emitter of the first transistor is coupled electrically to the second base, and the second emitter is grounded and the second collector is coupled electrically to the fifth conductor means. A sixth conductor means is attached at one end to the power source and is attached at another end to the fifth conductor means between the motor means and the point where said second collector is coupled thereto. A first diode means is connected within the sixth conductor means.

DESCRIPTION OF THE PREFERRED EMBODIMENT

Figure 1:
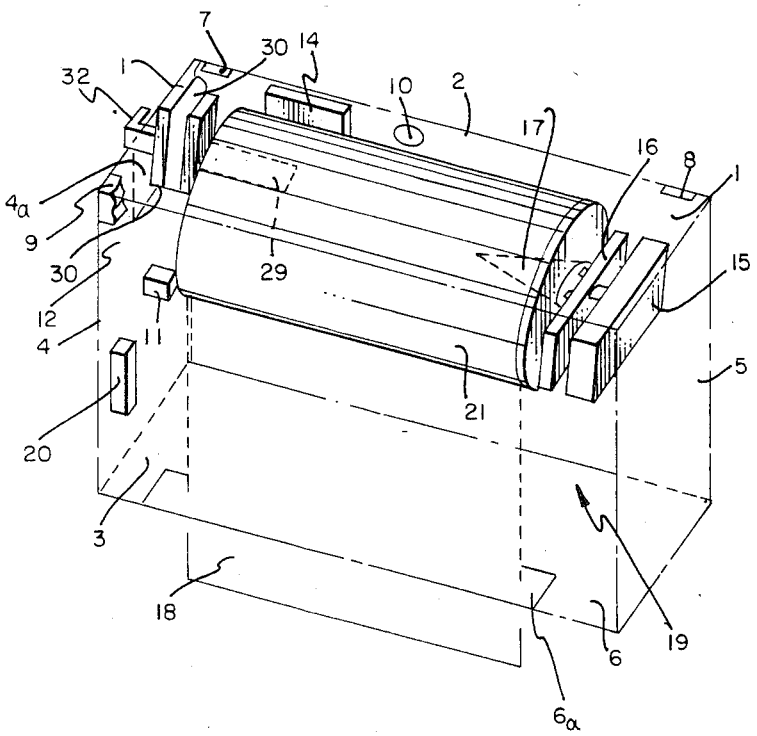
FIG. 1 is a perspective view of the electronic paper towel dispenser.

Referring to FIG. 1, the electronic paper towel dispenser cabinet 19 is a rectangle, square or similarly shaped cabinet comprising a front panel 3; a back panel 2; a left side panel 4 having an opening **4*a*; a right side panel 5; a top panel 1; and a bottom panel 6. The bottom panel 6 contains an opening 6*a* for dispensing of paper towels 18 from said cabinet 19**.

The top panel 1 is attached pivotally to said back panel 2 with hinges 7 and hinges 8 or other suitable means which will permit the top panel 1 to be opened or removed for accessing the interior of the cabinet 19 for installing new and removing empty paper towel rolls 21. The other panels could also be used for accessing the interior of the cabinet 19 if so desired. The top panel 1 is normally closed and held closed during operation of the electronic paper towel dispenser device by magnetic, friction or other suitable catches 9.

The cabinet 19 may be constructed from plastic, metal, paper or other material and may be a molded or formed one or more piece unit or may contain individual panels which are fastened together with glue or other means to form the appropriate cabinet 19 for the dispensing of paper towels 18.

A motor 15 is attached to a motor mounting bracket 16 with screws or other suitable means which will secure firmly the motor 15 in its proper operating position. The motor mounting bracket 16 may be constructed from metal, paper, glass, plastic or other suitable material and contains an opening for the motor 15 drive shaft. The motor mounting bracket 16 is attached to the back panel 2 with glue, screws or is otherwise made an integral part of said cabinet 19.

To the motor 15 drive shaft is attached a conical shaped drive bearing 17; and the drive bearing 17 is attached by using standard set screws or other suitable means which will secure said drive bearing 17 to the drive shaft of the motor 15. The drive bearing 17 may be constructed from metal, plastic or other material and covered with a sandpaper type of covering which when inserted into the tube holding the supply of the paper towels 18, sufficient friction and pressure will exist to cause the paper towel roll 21 to turn and the paper towels 18 to be dispensed through bottom opening 6a whenever the motor 15 is energized.

The drive bearing 17 may also be constructed from perforated plastic or perforated metal or similar material and be of such shape that when inserted into the tube holding the supply of paper towels 21, there will be sufficient pressure and friction to cause the roll of paper towels 21 to turn and unwind the paper towels 18 on the paper towel roll 21 through the opening 6a in the bottom panel 6.

Figure 3:
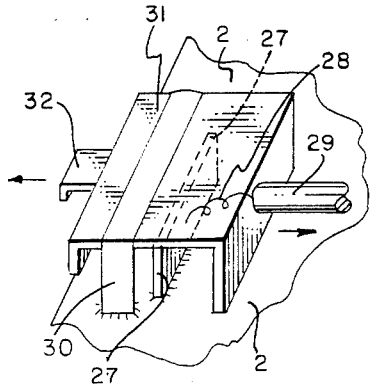
FIG. 3 is a perspective view of the assembly used to secure the paper towel at one end in place.

The end of the paper towel roll 21 opposite the motor 15 is held in place during normal operation by bearing 29 of which one end is inserted into the tube holding the supply of clean paper towels 21. This end is slightly smaller in diameter than the inside diameter of the core which it is inserted into which permits this end of the supply roll of paper towels 21 to turn freely on the bearing 29 when said motor 15 is energized. The opposite end of bearing 29 from the end inserted into paper towel roll 21 tube is bound, preferably integrally, to a frame assembly 31 which is slidably mounted along the back panel 2 to move in direction of the arrows in FIG. 3. A bracket 30 is secured to the back panel 2 and holds the frame assembly 31 in its proper location as it slidably moves along the face of the back panel 2. A spring 28 is attached to the stop member 27 and to the frame assembly 31 while the bearing 29 is also attached to the frame assembly 31. The handle 32 is attached to or otherwise made an integral part of said frame assembly 31 and protrudes or extends out of the side opening 4a as indicated in FIG. 1. When the handle 32 is pulled, the frame assembly 31 will remove the bearing 29 from within the core of the paper towel roll 21, and the empty core may be easily removed off the conical shaped bearing 17. The distance the frame assembly 31 may be pulled is determined by the location of the stop member 27 on the face of the panel back 2. While the frame assembly 31 is in its maximum pulled position, a new paper towel roll 21 may be installed by first inserting an end of the core of the paper towel roll 21 over the conical shaped bearing 17 and then aligning or registering the other end of the core with the drive bearing 29 and subsequently releasing the handle 32 which permits the spring 28 to force the bearing 29 forward to a point where it is inserted into the core of the tube holding paper towel roll 21. Once inserted, the spring 28 will continue to hold the roll of paper towels 21 in its proper location. As was indicated, the stop member 27 and the bracket 30 are attached to or otherwise made an integral part of said back panel 2.

When there is an absence of normal room lighting or normal room lighting is otherwise prevented from striking a night sensor 1, the motor 15 cannot be energized. If light is permitted to strike the night sensor 10 and you then place your hand or other object in front of a day sensor 11, the control circuit 14 will cause said motor 15 to be energized by battery power supply 20. Once motor 15 is energized, it will cause the drive bearing 17 to turn, which turns the paper towel roll 21 on bearing 29, and unwind the paper towel 18 through opening 6a in the bottom panel 6. The paper towels 18 will continue to advance until your hand or other object is removed from in front of the day sensor 11 or light is otherwise prevented from striking the night sensor 10. Without the action of the night sensor 10, paper towels 18 would be advanced each time normal room lighting was removed.

The battery power supply 20 or other suitable power means may be utilized in this device such as A.C. or an A.C. or D.C. converter or the control circuit 14 could be wired from a number of well known circuits which convert standard household current to the direct current required for operation of this device.

Figure 2:
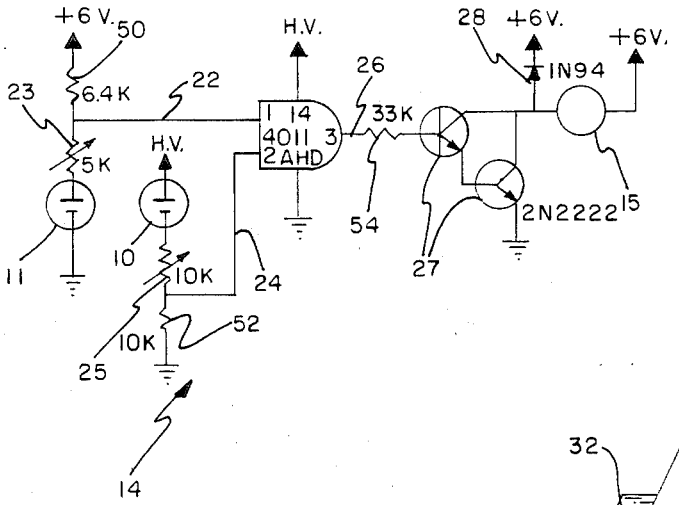
FIG. 2 is a schematic drawing of the control circuit.

Referring to FIG. 2 which is the schematic of the control circuit 14, the output at branch or conductor 22 is normally LOW. The variable resitor 23 communicating with the branch 22 is adjusted so that when your hand or other object is placed in front of the day sensor 11 which is located on or near the front of the cabinet 19, the normal LOW will be changed to a HIGH condition and will remain HIGH until your hand or other object is removed from in front of the day sensor 11 and light is once again permitted to strike the day sensor 11. The motor 15 will normally run while this HIGH condition exists providing there is light striking the night sensor 10.

The output at branch 24 is normally HIGH. The variable resistor 25 connected to the branch 24 is adjusted in such a manner that the normal HIGH condition at the branch 24 will be changed to a LOW condition whenever the normal room lighting is removed or the lighting is otherwise prevented from striking the night sensor 10. The motor 15 will not run while the output of the night sensor 10 is in a LOW state.

The output of the logic circuit operation 4081 AND circuit 26 which is at pin 3 is normally LOW. This will change to a HIGH condition anytime a HIGH condition exists at both branch 22 and branch 24. Branch 24 is normally HIGH and branch 22 will become HIGH whenever light is removed from the day sensor 1 which would normally occur when you place your hand in front of the day sensor 11.

Whenever the output of the logic circuit operation 4081 AND circuit 26 is HIGH, current will be provided the two 2n2222 transistors 27 and the motor 15 will run and the towels 18 subsequently unrolled. The motor 15 will run only while the output of the 4081 AND circuit 26 is HIGH.

The HIGH condition at the 4081 AND output 26 will be changed to a LOW condition when your hand or other object is removed from in front of the day sensor 11 or light is otherwise permitted to strike the day sensor 11. The HIGH condition at the 4081 AND output 26 will also be changed to a LOW state when light is removed or otherwise prevented from striking the night sensor 10. This would normally occur when the room lights are turned off.

The following conditions may occur at the branch 22, branch 24 and at the output of the logic circuit operation 4081 AND circuit 26:

| Branch 22 | Branch 24 | Output logic circuit 26 |
|---|---|---|
| HIGH (NO LIGHT) | HIGH (LIGHT) | HIGH (MOTOR RUNS) |
| LOW (LIGHT) | HIGH (LIGHT) | LOW (MOTOR OFF) |
| HIGH (NO LIGHT) | LOW (NO LIGHT) | LOW (MOTOR OFF) |
| LOW (LIGHT) | LOW (NO LIGHT) | CONDITION NOT POSSIBLE |

The diode 28 helps prevent the destruction of the transistors 27 when the motor 15 is energized. The control circuit 14 also includes as indicated resistors 50 (preferably 6.4KΩ), resistor 52 (preferably 10KΩ) and resistor 54 (preferably 33KΩ).

While the above description contains many specificities, these should not be construed as a limitation on the scope of the invention, but rather as an exemplification of one preferred embodiment thereof. Many other variations in size, shape and material are possible while still remaining within the spirit of this invention. Therefore, the scope of the invention should be determined not by the embodiment illustrated but by the appended claims and their legal equivalents.

I claim:

1. A paper towel dispenser comprising a cabinet means including a back panel, a top pivotally secured to said back panel, a first side panel secured to said back panel, a second side panel having a side opening and secured to said back panel, a front panel secured to said first and second side panels, and a bottom panel having a bottom opening and secured to said first and second side panels and to said front and back panels, a motor means secured to said back panel for producing rotational energy; a control circuit means mounted in said cabinet means and comprising a touchless switch means for energizing and de-energizing said motor means and dispensing paper towels in a sanitary manner; cone-shaped bearing means coupled to said motor means and frictionally, rotationally engages one side of paper towels for dispensing same when said motor means is energized; a stop member mounted to said back panel; a second bearing means releasably engaging another side of the paper towels and supporting the same while being rotationally dispensed when the cone-shaped bearing means is rotated by the motor means; a bracket assembly integrally bound to said second bearing means and superimposed over the stop member and slidably mounted along the back panel in proximity to said side opening; and a means secured to said stop member and to said bracket assembly for biasing said bracket assembly away from said stop member and for biasing said second bearing means towards said paper towels.

2. The paper towel dispenser of claim 1 wherein said control circuit comprises a first conductor means in communication with a power source at one end and grounded at the other end, a day sensor means and a first variable resistor and a first resistor all connected in series in said first conductor means; a second conductor means connected to said first conductor means between said first variable resistor and said first resistor and further connected to a logic circuit operation 4081 AND means; a third conductor means having one end in communication with the power source and another end grounded, a night sensor means and a second variable resistor and a second resistor all connected in series in said third conductor means; a fourth conductor means attached to said logic circuit operation 4081 AND means and to said third conductor means between said second variable resistor and said second resistor; a fifth conductor means attached to said logic circuit operation 4081 AND means and in communication with said power source, a third resistor and a first transistor and said motor means all connected in series in said fifth conductor means, said first transistor having a first base, a first emitter and a first collector; a second transistor having a second base, a second emitter and a second collector, said first emitter of said first transistor is coupled electrically to said second base, said second emitter is grounded and said second collector is coupled electronically to said fifth conductor means; a sixth conductor means attached at one end to the power source and attached at another end to the fifth conductor means between the motor means and the point where said second collector is coupled thereto, and a first diode means connected within said sixth conductor means.

3. The paper towel dispenser of claim 2 wherein said logic circuit operation 4081 AND means is in communication with said power source at a point thereon, and is grounded at another point thereon.

4. The paper towel dispenser of claim 2 wherein said power source is a battery mounted in said cabinet means.

5. The paper towel dispenser of claim 2 wherein said touchless switch means comprises said night sensor means communicating with ambient light such that when ambient light does not strike the night sensor means said control circuit means can not energize the motor means; and said day sensor means communicating with said ambient lighting such that if ambient lighting is striking the night sensor means, then interrupting the ambient lighting to the day sensor means causes the control circuit means to energize the motor means.

6. The paper towel dispenser of claim 1 additionally comprising a handle secured to said bracket assembly.

* * * * *